US008808076B2

(12) United States Patent
Chich et al.

(10) Patent No.: US 8,808,076 B2
(45) Date of Patent: Aug. 19, 2014

(54) IMPELLER EXHAUST RIDGE VENT

(75) Inventors: Adem Chich, Kearny, NJ (US); Sudhir Railkar, Wayne, NJ (US); Walter Zarate, Prospect Park, NJ (US); Brian Duffy, Wayne, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 1670 days.

(21) Appl. No.: 11/599,087

(22) Filed: Nov. 14, 2006

(65) Prior Publication Data

US 2008/0113612 A1 May 15, 2008

(51) Int. Cl.
*F24F 13/08* (2006.01)

(52) U.S. Cl.
USPC ..... 454/365

(58) Field of Classification Search
USPC ..... 454/341, 365, 364, 366, 367, 1; 52/302.1, 302.3
See application file for complete search history.

(56) References Cited

U.S. PATENT DOCUMENTS

| | | | | |
|---|---|---|---|---|
| 2,997,132 | A | 8/1961 | Allander | |
| 3,080,695 | A * | 3/1963 | Hay | 55/470 |
| 3,223,018 | A | 12/1965 | Tucker | |
| 3,311,047 | A * | 3/1967 | Smith et al. | 454/365 |
| 4,017,028 | A | 4/1977 | Manor | |
| 4,616,660 | A | 10/1986 | Esposito | |
| 5,149,301 | A * | 9/1992 | Gates | 454/365 |
| 5,288,269 | A * | 2/1994 | Hansen | 454/365 |
| 5,551,508 | A * | 9/1996 | Lim et al. | 165/122 |
| 5,772,502 | A * | 6/1998 | Smith | 454/365 |
| 5,803,805 | A * | 9/1998 | Sells | 454/364 |
| 5,946,868 | A * | 9/1999 | Morris | 52/199 |
| 6,128,870 | A | 10/2000 | Kohler | |
| 6,159,093 | A | 12/2000 | Mihalko | |
| 6,185,880 | B1 | 2/2001 | Richardson | |
| 6,240,690 | B1 * | 6/2001 | James et al. | 52/302.3 |
| 6,561,181 | B2 * | 5/2003 | Tseng et al. | 126/299 R |
| 6,666,762 | B2 * | 12/2003 | Richardson | 454/346 |
| 6,883,251 | B2 * | 4/2005 | Terrell et al. | 34/527 |
| 7,094,145 | B2 | 8/2006 | Rye et al. | |
| 2005/0191957 | A1 * | 9/2005 | Demetry et al. | 454/341 |
| 2006/0035582 | A1 * | 2/2006 | Collister et al. | 454/365 |

FOREIGN PATENT DOCUMENTS

| | | | |
|---|---|---|---|
| DE | 1604185 A | * | 9/1970 |
| JP | 06026118 A | * | 2/1994 |

OTHER PUBLICATIONS

International Search Report—PCT/US2007/23847.

* cited by examiner

*Primary Examiner* — Steven B McAllister
*Assistant Examiner* — Brittany Towns
(74) *Attorney, Agent, or Firm* — Womble Carlyle Sandridge & Rice LLP

(57) ABSTRACT

An impeller exhaust ridge vent is provided for covering a ridge slot formed along the ridge of a roof. The ridge vent has an elongated laterally flexible center panel with edge portions along which vents are formed. Standoffs can depend from the bottom of the center panel for supporting the center panel a predetermined distance above the roof deck so that attic air can vent through the ridge slot, beneath the center panel, and exit through the vents. A base panel can be provided to cover the roof deck and form a smooth substantially sealed air duct for passage of the air. Upstanding wind baffles are disposed outboard of and spaced from the vents. One or more tangential impellers is rotatably mounted in the pace between the vents and wind baffles and can be free spinning or driven by an electric motor. Rotation of the tangential impellers creates a cross-flow fan effect that draws air forcibly from beneath the center panel and exhausts it to ambience. The attic space is thereby actively ventilated.

19 Claims, 5 Drawing Sheets

IMPELLER EXHAUST RIDGE VENT

TECHNICAL FIELD

This invention relates generally to attic ventilation systems and more specifically to ridge vents.

BACKGROUND

It is important in modern buildings such as homes and offices that the attic space of the building be well ventilated. Attic ventilation reduces the searing heat that can build up in the attic during summer months, thereby reducing substantially the cooling costs and other problems associated with the attic heat. It is equally important that moist air be removed from the attic to reduce and control humidity, which otherwise can result in mold, mildew, and rot within the attic and living spaces. Removal of heat and humidity from attic spaces traditionally has been accomplished with attic ventilation systems of various designs. Such systems include, for example, simple gable vents to promote cross-ventilation through the attic, static roof vents located at strategic positions along the slope of a roof, and active attic ventilation systems, which usually include thermostats and/or humidistats that activate electric attic fans above a predetermined temperature and/or humidity. Static and active attic ventilation systems generally are used in conjunction with soffit or eve vents, which admit fresh outside air into the attic to replace the hot and/or humid air that is removed.

More recently, ridge ventilation or ridge vent systems have become popular for ventilating the attic space of a building. Ridge ventilation systems generally include a long opening known as a "ridge slot" cut along the apex or ridge or a gable roof through which hot air can escape the attic below as a result of natural convection. An elongated ridge vent extends along and covers the ridge slot and is designed to allow air to escape while preventing rain water and pests from entering the attic through the open slot. Early ridge vents were made of roll formed aluminum. Later ridge vent designs included lengths of corrugated or fibrous material that covered the ridge slot. Ridge cap shingles were applied atop these later ridge vent designs to cover them and provide a pleasant appearance.

More sophisticated ridge vents have evolved that generally are formed of injection molded plastic vent sections that are attached to the roof end-to-end along the ridge to span and cover the ridge slot. The vent sections generally have transversely flexible center panels flanked along their outside edges with vents covered by vent louvers. The center panel is held a short distance above the roof deck by depending stand offs or supports to maintain a space between the center panel and the roof. The vent louvers cover the vents to prevent pest infestation while permitting air to flow through the vents. Such ridge vents also usually are formed with upstanding wind baffles outboard of and spaced from the vents. The wind baffles generate higher velocity and thus lower pressure vortices or zones in the region of the vents as a breeze blows across the roof and over the wind baffles. This is known as the Bernoulli effect. These lower pressure zones help to draw air from beneath the ridge vent and thus out of the attic below. Once these ridge vents are installed, ridge cap shingles are applied over the top of the center panels to provide an aesthetically pleasing appearance. Many ridge vents are formed with weep holes located at intervals along the bottoms of the wind baffles to allow rain water to escape from the space between the vents and the wind baffles.

While the latter more sophisticated types of ridge vents have proven quite successful at ventilating an attic, they nevertheless are plagued with numerous problems and shortcomings inherent in their designs. For example, these ridge vents rely largely on natural convection or the rising of hotter air within the attic to achieve good ventilation. While this is reasonably effective for ventilating hot attics, it does not provide much ventilation of the moist humid air that can form in cooler attics where there may be little or no heat induced convection. Further, since the Bernoulli effect is generated only when a breeze blows across the wind baffles, these ridge vents become purely passive and rely exclusively on convection when the outside air is static and there is no breeze. Even when there is a breeze, its direction can effect the efficiency of ventilation. For instance, if the breeze happens to blow along the length of the ridge vent rather than across its width, the resulting Bernoulli effect is minimal and, again, the ridge vent becomes essentially passive.

Some attempts have been made to provide ridge vents with active supplemental ventilation to address problems such as those discussed above. These attempts include, for example, electric fans inside the attic that blow air up and out the ridge slots, electric fans in stacks extending upwardly from the ridge vent, and electric soffit fans that blow outside air into the lower regions of the attic thereby forcing attic air to exit through the ridge vents. Such attempts may be useful, but can be complex, cumbersome to install, difficult to maintain, and less effective than desired.

Accordingly, a need persists for a ridge ventilation system that addresses the problems and shortcomings of present systems. Such a system should provide efficient and effective attic ventilation under all wind conditions, including when there is no wind or when the wind direction coincides with the direction of the roof ridge. It should be capable of drawing moist humid air out of the attic even when the air in the attic is cooler and there is little or no heat induced convection to cause airflow. All of these functions and more should be accomplished with a system that is efficient, simple to install, virtually maintenance free, and highly reliable for many years. It is to the provision of such a ridge ventilation system that the present invention is primarily directed.

SUMMARY OF THE INVENTION

Briefly described, the present invention, in one preferred embodiment, comprises an impeller exhaust ridge vent designed to extend along and cover an open ridge slot along the ridge of a roof. The ride vent includes a laterally flexible central panel having edge portions and a width sufficient to span and cover the ridge slot. Depending standoffs or supports can be formed on the bottom of the central panel for supporting the central panel above and spaced from the roof deck. A base panel spaced from the central panel may be provided to cover the roof deck and form a smooth substantially sealed air duct between the base panel and the central panel. Vents are thereby formed along the edge portions and vent louvers cover the vents to allow air to escape from beneath the central panel while inhibiting debris and pests from entering. Upstanding wind baffles are disposed outboard of and spaced from the vents and extend along the ridge vent to define a trough between the edges of the central panel and the wind baffles. At least one tangential impeller has a plurality of impeller blades and is rotatably mounted in the trough with its axis of rotation extending generally along the length of the ridge vent. The tangential impeller combined with the edge of the central panel on one side and the upstanding wind baffle on the other form a "cross-flow fan" adjacent the vent. Rotation of the tangential impeller creates a displaced stable vortex according to the principles of cross-flow fan operation. The displaced vortex, in turn, causes air to be drawn from beneath the central panel, and thus out of the attic through the ridge slot. The air is then exhausted, also according to the principles of cross-flow fan operation, up and away from the trough in which the impeller is mounted. Accordingly, the rotating tangential impeller transforms the otherwise passive ridge vent into an active ventilation system that forcibly draws air out of the attic below.

In one embodiment, the tangential impeller is mounted for free rotational movement within the trough. With this embodiment, the force of a breeze blowing across the roof and over the ridge vent causes the tangential impeller to spin, thus generating the active suction of air from the attic. In another embodiment, the tangential impeller is coupled to a small electric motor, which rotates the tangential impeller when activated. The electric motor can be powered by any suitable source of electricity such as, for example, the building's electrical service, a solar panel, batteries, a wind generator, or combinations thereof. In any event, activation of the electric motor preferably is controlled by a controller that receives signals from temperature and humidity sensors within the attic. The controller is configured to activate the electric motor, and thus to spin the tangential fan, upon the occurrence of predetermined temperature and humidity conditions within the attic. With this powered embodiment of the invention, air can be forcibly drawn out of the attic without regard to the presence of an outside breeze or the presence of hot attic air to drive convection based ventilation. Thus, efficient ventilation can be accomplished when there is no breeze or when the breeze happens to be blowing along the length of the ridge vent. Equally importantly, attic ventilation can be achieved under conditions where passive ridge vents provide little or no ventilation. For example, if the attic air is too cool to drive convection based ventilation, but it nevertheless is desirable to ventilate the attic because of high humidity conditions therein, the motor of the present invention can be activated to draw the humid air out of the attic through the ridge slot. Other conditions may exist in which active ventilation can be accomplished with the present invention under circumstances where natural ventilation might not otherwise occur.

Thus, a novel new ridge vent is now provided that successfully addresses the problems and shortcomings of prior art ridge vents discussed above. These and other features and advantages of the present invention will become more apparent upon review of the detailed description set forth below, when taken in conjunction with the accompanying drawing figures, which are briefly described as follows.

DETAILED DESCRIPTION OF THE PREFERRED EMBODIMENTS

Figure 1:
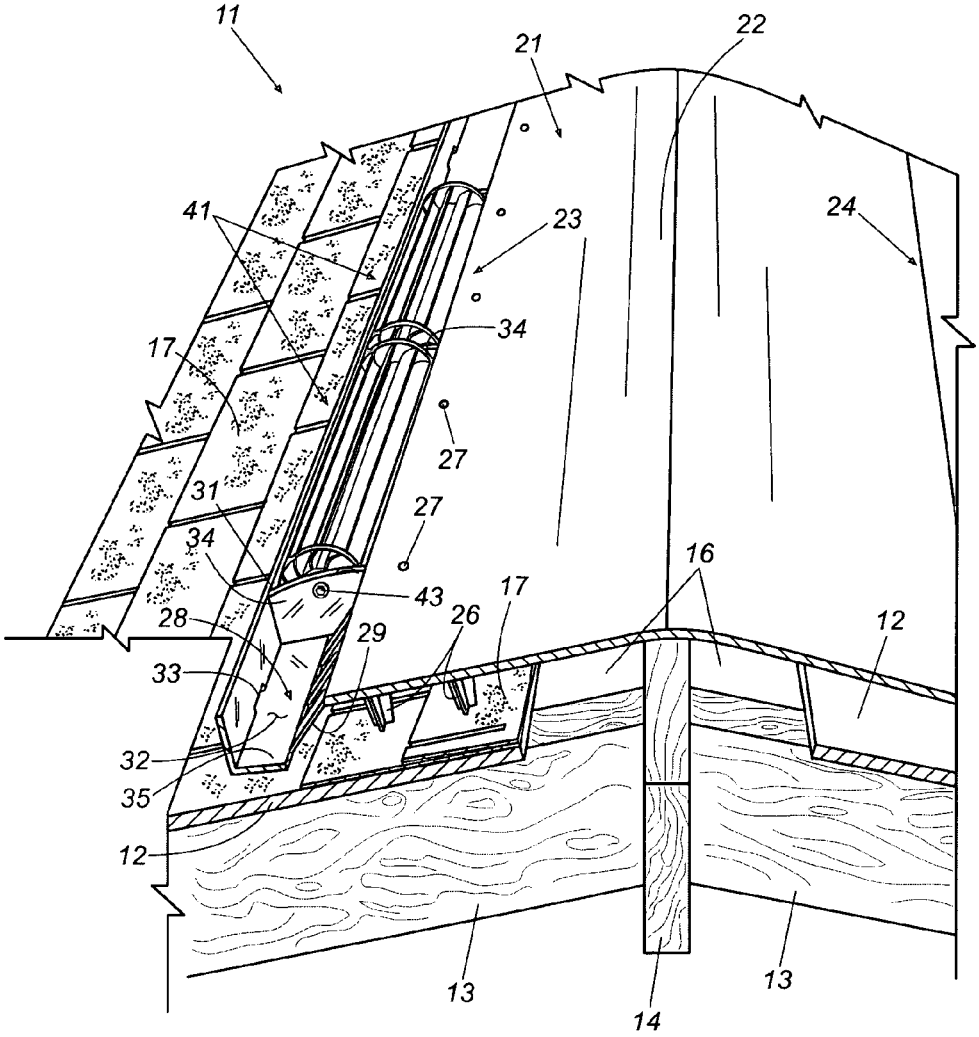
FIG. 1 is a perspective view, partially in cross-section, showing a impeller exhaust ridge ventilation system that embodies principles of the present invention in a preferred form.

FIG. 1 is a perspective partially sectional view of an impeller exhaust ridge vent of this invention installed on the ridge of a roof. It will be understood that while only a short section of the ridge vent is shown in FIG. 1, the ridge vent preferably extends along a substantial portion of the length of the roof ridge. This may be accomplished by attaching shorter ridge vent sections end to end along the ridge, or by using a continuous rolled ridge vent configuration as is known in the art. Further, while only one side of the ridge vent is depicted in FIG. 1, the non-visible side is substantially a mirror image thereof and descriptions of elements on the visible (left) side in FIG. 1 apply equally to the non visible (right) side.

Referring in more detail to FIG. 1, the impeller exhaust ridge vent 11 is installed along the ridge of a gable roof. The roof, in this example, comprises a roof deck 12 that is supported atop rafters 13. The rafters 13 meet and are attached at a ridge beam 14 that extends along the roof ridge. The roof deck 12 is cut away on either side of the roof ridge to form a ridge slot 16 that is open to the attic space below. The roof deck 12 is covered with shingles 17 that extend underneath the impeller exhaust ridge vent toward the ridge slot 16 as shown. The ridge vent 11 comprises a center panel that has a central portion 22 and edge portions 23 and 24. The center panel preferably is made of plastic and is laterally flexible so that it can be bent across a roof ridge and conformed to virtually any roof pitch. An array of standoffs or supports 26 depend from the bottom surface of the center panel to rest on the roof deck. The standoffs are shown for clarity in FIG. 1 to be simple feet; however, they can take on a variety of shapes from spaced individual stanchions to depending walls, as is known in the art. In any case, the standoffs support the center panel a predetermined distance above the roof deck to define a space between the roof deck and the bottom of the center panel 22. The ridge vent is secured to the roof deck with fasteners 27, which typically are nails but can be screws or any other appropriate fastener. As is common, ridge cap shingles are installed atop and cover the center panel 21 to provide protection and an aesthetically pleasing appearance. For clarity of illustration and understanding of the present invention, the ridge cap shingles are not shown in the drawing figures.

A vent 28 is formed along the edge portion 23 of the center panel 21 to permit air to escape from beneath the center panel. Preferably, the vent 28 is covered by vent louvers 29 to prevent pests and debris from passing through the vent 28 and entering the attic through the ridge slot 16. The vent louvers 29 can take on any appropriate configuration, but are shown in FIG. 1 as arrays of simple spaced apart ribs extending from the edge of the center panel downwardly toward the roof deck. An upstanding wind baffle 31 is located outboard of the vent 28 and vent louvers 29 and extends along the length of the ridge vent 11. The wind baffle 31 thus defines a trough 32 bounded on the inside by the vent 28 and on the outside by the wind baffles 31. The wind baffle 31 in this embodiment is supported by a series of spaced buttresses 34 that extend from beneath the center panel outwardly to the wind baffles. A floor is formed at the bottom of the trough 32 and weep holes 33 may be formed at spaced intervals along the intersection of the wind baffle 31 and the floor 35 to permit rain water to drain out of the trough 32 and onto the adjacent roof deck.

Figure 4:
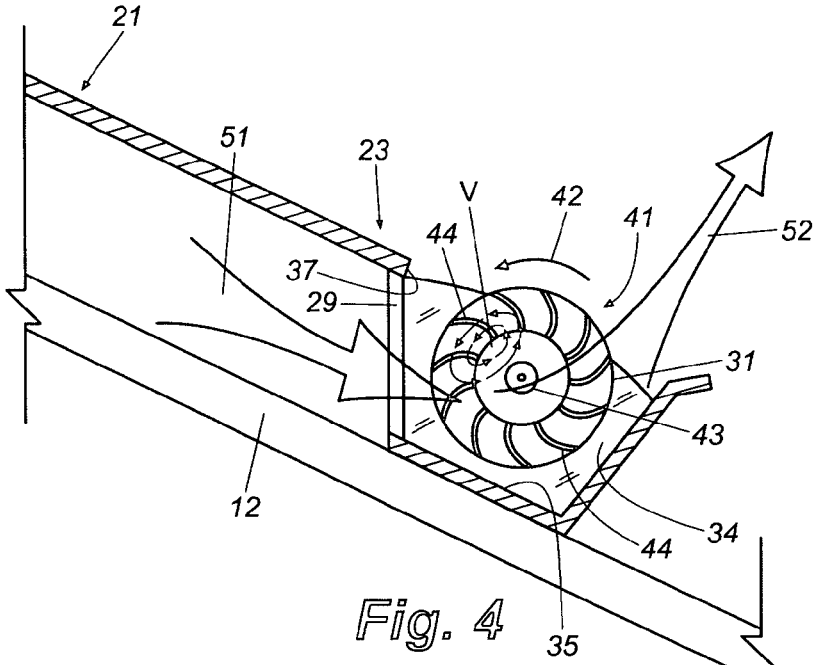
FIG. 4 is a cross sectional magnified view of an edge portion of the inventive ridge vent taken along A-A of FIG. 3 and illustrating a preferred configuration and function of the impeller and its relationship to other elements of the ridge vent.

According to the present invention, one or more impellers 41 are disposed in the trough 32 and are rotatably mounted therein for rotation about an axis that extends along the length of the trough. In the preferred embodiment, each impeller is of the generally elongated cylindrical type having a plurality of radially arrayed, spaced apart, and axially extending impeller blades 44 (FIG. 4). This type of impeller commonly is referred to as a "tangential impeller." End caps are located at the ends of the impellers 41 and are provided with axles 43. Axles 43 are rotatably journaled within corresponding openings or holes in buttresses 34 disposed adjacent the ends of the impeller. The configurations and relative sizes of the axles 43 and the holes in buttresses 34 are such that the impellers 41 are freely rotatable about their axles 43 within the trough 32. Other appropriate mechanisms for mounting the impellers to the ridge vent also are contemplated, such as, for instance, clips, fasteners, or the like.

Preferably, the impellers 41 are sized and mounted so that a portion of each impeller projects upwardly above the top edge of the wind baffle 31 and above the edge of the center panel 21, for purposes described in more detail below. FIG. 1 illustrates a pair of impellers 41 mounted end-to-end within a portion of the trough 32. It will be understood that any other placement and configuration of the impellers within the troughs of the ridge vent 11 is possible and contemplated by the present invention. For example, rotatable impellers may be arrayed along the entire length of the trough 32, or they may be disposed at spaced intervals along the trough with lengths of unoccupied trough between them. Further, the impellers can be mounted so that they are free rotating within the trough, or they can be forcibly driven by an electric motor, as detailed below.

Operation of the impeller exhaust ridge vent of this invention is described in detail below in conjunction with the remaining drawing figures. In general terms, however, the tangential impellers in conjunction with the adjacent edge of the center panel 21 on one side and the wind baffle on the other form a classic cross-flow fan. Rotation of the impellers within the troughs generates, according to principles of cross-flow fan operational, a stable vortex within the trough with the stable vortex being displaced toward the edge of the center panel. The stable vortex, in turn, creates a relatively lower pressure zone outboard of the vortex, which causes air to be drawn forcibly from beneath the center panel and ejected from the trough. Thus, the ridge vent of this invention becomes an active ventilation system upon rotation of the tangential impellers and forcibly draws attic air out through the ridge slot and exhausts the air from the troughs of the ridge vent. In one embodiment, the tangential impellers 41 are mounted for free rotation within the trough. The force of a breeze blowing across the roof ridge causes the impellers to spin, thus drawing air from the attic as described. In another embodiment, the tangential impellers are driven by a small electric motor, the electric power for which may originate from the buildings electrical service, from solar cells, batteries, or even wind generators, or combinations thereof. This later embodiment has advantages over the free rotating impeller embodiment because the impellers can be spun to draw air from the attic under any conditions, such as at night when convection driven ventilation through passive vents otherwise is minimal.

Figure 2:
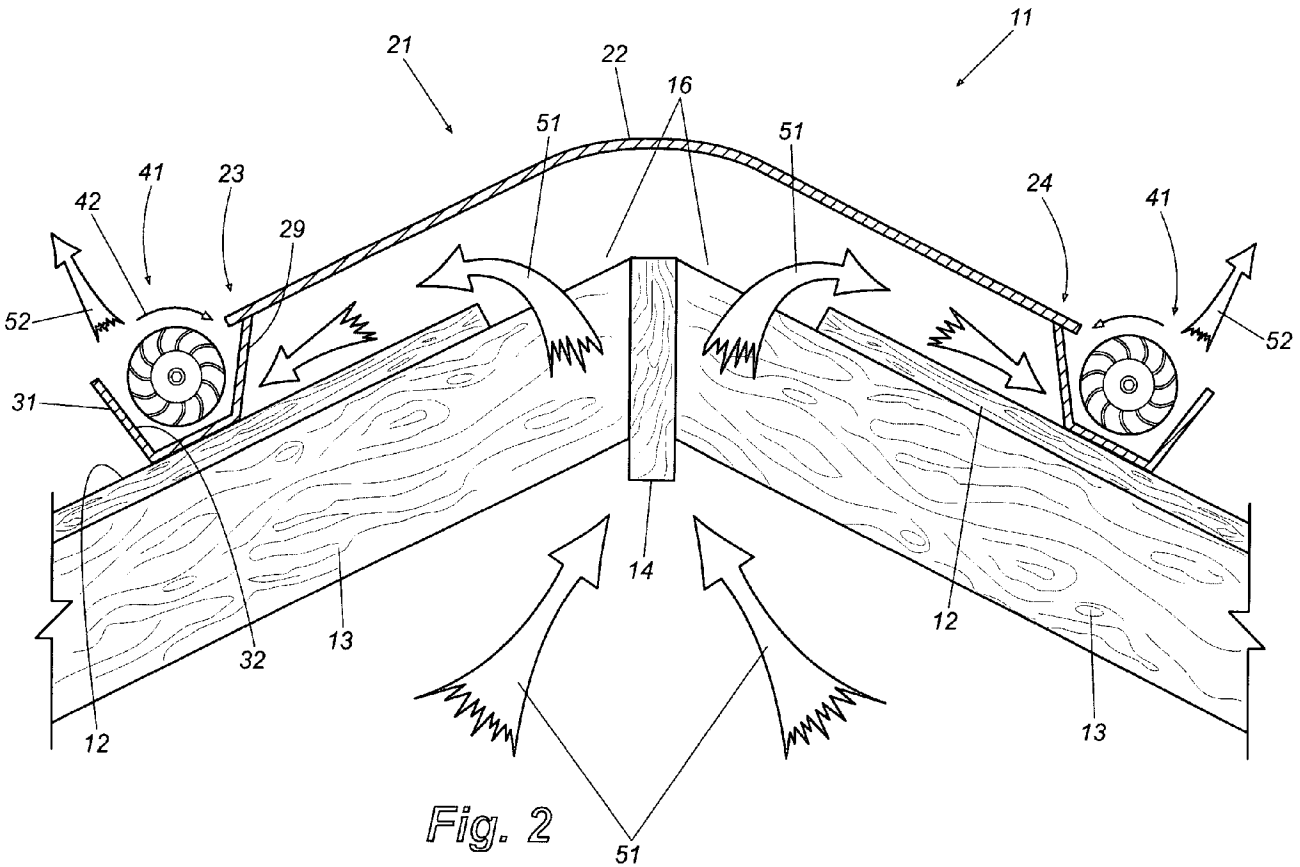
FIG. 2 is a cross sectional view of the ridge ventilation system of FIG. 1 illustrating airflow from the attic and through the vent.

FIG. 2 illustrates more clearly the operation of the impeller exhaust ridge vent of this invention. The ridge vent 11 is seen mounted along the ridge of a roof as described above with its laterally flexed center panel 21 covering the open ridge slot 16. For clarity, shingles are not explicitly shown in this figure; however, it will be understood that shingles cover or are a part of the roof deck. A space or ventilation channel is formed between the center panel 21 and the roof deck 12 and the center panel 21 is flanked by a vent 28 covered by vent louvers 29 and an upstanding wind baffle 31, which define the trough 32. Tangential impellers 41 are rotatably disposed within the trough 32, preferably with a portion of the impellers projecting up out of the trough as shown. The edge 23 of the center panel 21 and the upstanding wind baffle 31, in combination with the tangential impeller 41, form a somewhat traditional cross-flow fan along and adjacent the vent 28. More specifically, the edge of the center panel 21 defines a vortex tongue of the cross-flow fan while the wind baffle forms the cowling known as the "rearguider" of the cross-flow fan. As the tangential impellers rotate or are rotated in the directions of arrows 42, a displaced stable vortex is created within the trough 32 adjacent to and along the vortex tongue formed by the edge of the center panel. This, in turn, generates a lower pressure zone along the bottom and outside of the trough according to principles of cross-flow fan operation. This lower pressure zone, then, draws air from the attic, through the open ridge slot 16, and laterally beneath the center panel 21 as indicated by directional arrows 51. The air is expelled or exhausted upwardly out of the troughs, again according to cross-flow fan operating principles, as indicated by directional arrows 52. As mentioned above, rotation of the tangential impellers can be caused by wind blowing across the roof, or the impellers can be actively driven by an appropriate electric motor. In either case, and particularly in the later, the cross-flow fan effect enhances the ventilation provided by the ridge vent over that of static ridge vent designs of the past.

Figure 3:
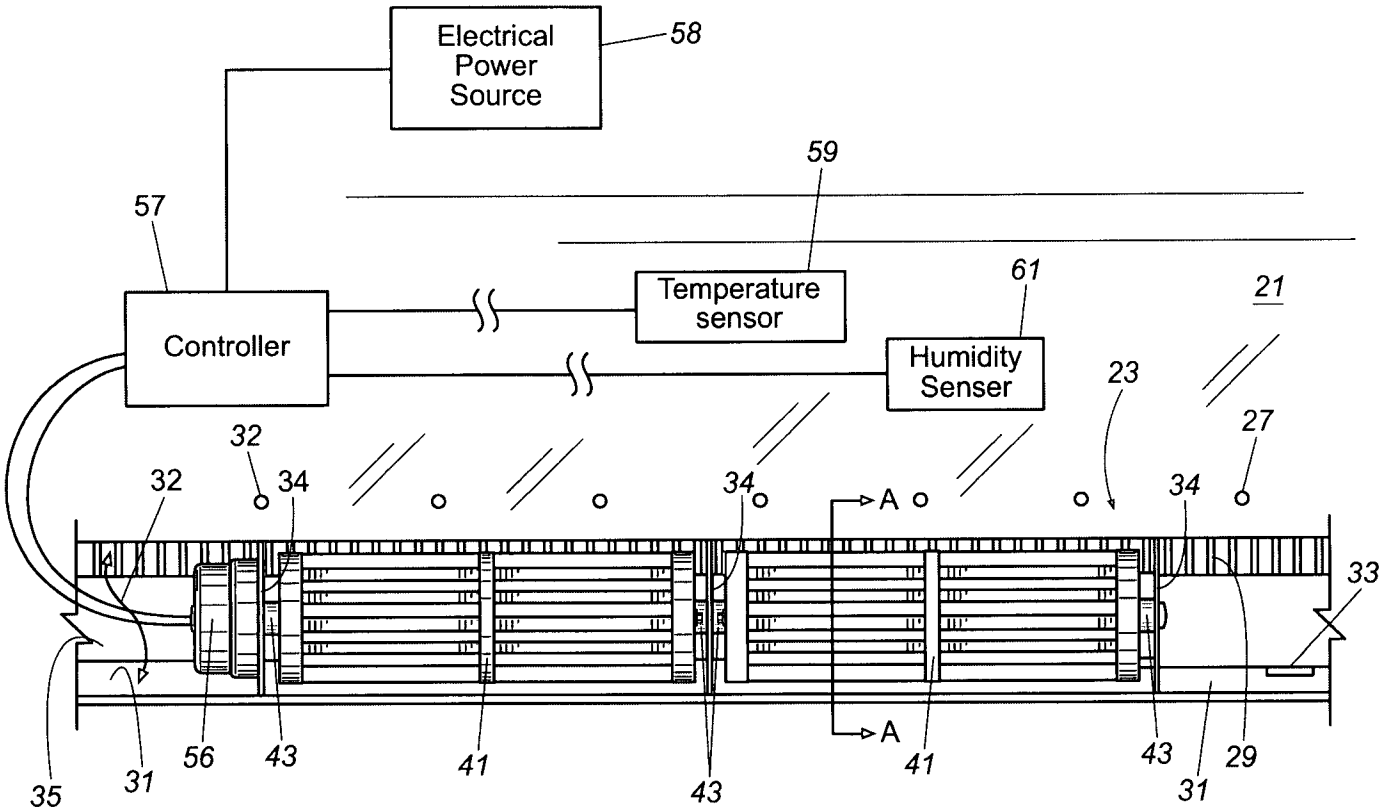
FIG. 3 is a top plan view showing one edge portion of a ridge ventilation system and illustrating a preferred placement of a powered impeller according to the invention.

FIG. 3 is a top plan view of a section of an edge portion 23 of the ridge vent of this invention, and illustrates in more detail the electric motor driven embodiment thereof. The center panel 21 is fastened to the roof deck with nails or other appropriate fasteners 27 as discussed above. Vent louvers 29 cover the vent 28 along the edge of the center panel 21. The upstanding outboard wind baffle 31 defines a trough 32 between the vent 28 and the wind baffle 31. Weep holes 33 are formed along the intersection of the wind baffle and the floor of the trough to facilitate the escape of rainwater. The wind baffle 31 is braced and supported by buttresses 34 that extend laterally across the width of the trough.

According to the present invention, a pair of tangential impellers 41 are rotatably mounted in the trough 32 and extend partially along the length thereof. In the illustrated example, the tangential impellers are mounted by means of axles 43 that are rotatably journaled within corresponding holes formed in buttresses 34. However, other mechanisms for mounting the impellers within the trough are possible and contemplated by the present invention. Such mechanisms may include clips or fasteners with which an impeller unit cam simply be snapped or attached within the troughs. In the illustrated embodiment, the axle 43 on the left in FIG. 3 extends through the buttress 34 and is coupled to and electric motor 56, which, when activated, spins the axle 43, thereby rotating the tangential fans 41 within the trough. While any appropriate electric motor may be employed, it is preferred that the electric motor 56 be a sealed, brushless, low voltage electric motor for endurance, reliability, and safety. The electric motor 56 is electrically connected to a controller 57, which can be a microcontroller or microprocessor. The controller 57, in turn, receives power from an electrical power source 58, which can be any of a variety of power sources including, for instance, a home's electrical service, a solar power array, a battery, a wind generator, or combinations thereof. The controller 57 also receives signals from sensors that may be located within the attic space below the roof deck. In the illustrated embodiment, these sensors include a temperature sensor 59 and a humidity sensor 61 that monitor temperature and humidity conditions within the attic and produce electrical signals indicative thereof. Other types of sensors such as, for instance, a wind speed sensor and/or an ambient light sensor, also might be coupled to provide to the controller 57 additional signals indicative of other conditions.

The controller 57 is appropriately programmed to monitor the signals of the sensors such as temperature sensor 59 and humidity sensor 61 and to activate and deactivate the electric motor 56 to spin the tangential impellers based upon predetermined conditions. The spinning of the impellers, in turn, actively draws air out of the attic and exhausts it to the atmosphere due to the cross-flow fan effect, as discussed above. It may be determined, for example, to activate the impellers when the attic temperature rises above a certain minimum temperature to draw more hot air out of the attic than is vented by passive convection. It may further be determined to activate the impellers upon the occurrence of combinations of conditions, such as, for instance, when the attic temperature is to low to generate significant convective ventilation, but the humidity within the attic is above a selected threshold indicating that the attic requires ventilation to lower the humidity. Other conditions may dictate activation of the impellers as well. For example, the impellers might be operated on a time schedule or when there is no ambient breeze or when the ambient breeze is blowing along rather than across the roof ridge. These and other conditions and rules for operating the tangential impellers to draw air out of and ventilate the attic are possible and all such conditions and rules are contemplated and intended to fall within the scope of the present invention.

FIG. 4 illustrates in more detail the operation of the cross-flow fan created by the tangential impeller, the edge of the center panel, and the wind baffle. As discussed, the tangential impeller 41 is rotatably mounted in the trough 32 for rotation in the direction of arrow 42. The edge 23 of the center panel extends along and adjacent to the tangential fan on the left side and forms the vortex tongue 37 of the cross-flow fan. The floor 35 and the upstanding wind baffle 31 extend and generally wrap around the right side of the tangential impeller and form the rearguider of the cross-flow fan. As the tangential impeller spins in the direction of arrow 42, a stable vortex V forms within the trough, and the vortex V is displaced generally toward the direction of the vortex tongue 37, all according to principles of cross-flow fan operation. This, in turn, gives rise to a relatively lower pressure zone along the outside portion of the trough 32, which sucks or draws air 51 out through the vent 28 and exhausts the air up and out of the trough, as indicated by directional arrow 52. In this way, the cross-flow fan effect actively draws air from the attic below and exhausts the attic air to ambience in a manner that provides enhanced attic ventilation over prior art static ridge vents. Ventilation also can be obtained under conditions such as lower attic temperatures and or calm breezes where convective ventilation or the Bernoulli effect generated by the wind baffles in a breeze are not present.

Figure 5:
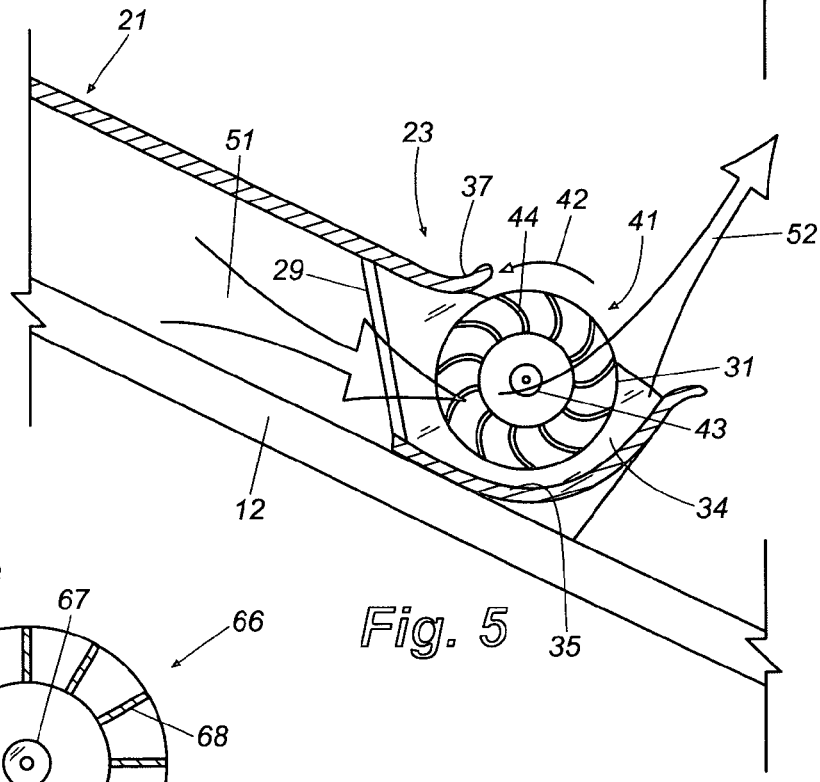
FIG. 5 is a cross sectional magnified view illustrating an alternate configuration of the edge portion of the inventive ridge vent wherein the wind baffle and the outside edge of the center panel are shaped to provide more efficient ventilation.

FIG. 5 illustrates and alternate embodiment of the present invention that may provide more efficient and effective operation of the cross-flow fan. In this embodiment, the tangential impeller 41 is again mounted within the trough of the ridge vent for rotation in the direction of arrow 42. In this embodiment, the edge 23 of the center panel 21 projects toward the tangential impeller 41 and terminates in a smooth upturned configuration that forms a somewhat rounded and smooth vortex tongue 37 extending along the length of the tangential impeller. The generally flat floor of the trough and the upstanding generally flat wind baffle of the prior embodiment are replaced in the embodiment of FIG. 5 with a single curved surface that extends upwardly from the bottom of the vent louvers 29 and generally diverges from the tangential fan to terminate at it upper edge in wind baffle 31. This configuration forms a more traditional curved and diverging rearguider of the cross-flow fan, which is believed to be more efficient. As with the prior embodiment, rotation of the tangential impeller in the direction of arrow 42 creates a stable displaced vortex along the trough that, in turn, causes air to be drawn out of the attic and exhausted, as indicated by directional arrows 51 and 52.

Figure 6:
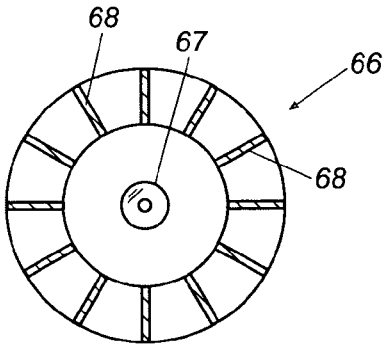
FIG. 6 is a cross sectional view of an alternate embodiment of the impeller of this invention illustrating radially extending impeller blades.

As previously mentioned, the tangential impeller 41 is formed with an array of impeller blades 44 (FIG. 5) that extend axially along the length of the impeller. In the embodiments of FIGS. 1 through 5, the impeller blades 44 are shown to be curved in the direction of rotation of the impeller. More specifically, these blades preferably follow the curve of an Archimedes spiral because such a blade configuration has proven to be efficient for use in cross-flow fans. Nevertheless, impeller blades with other shapes may be preferred for a variety of reasons such as manufacturing simplicity. FIG. 6 for example, illustrates a tangential impeller 66 having an axle 67 and impeller blades 68 that are flat and radially extending. Other blade configurations are possible, such as blades that are flat but are angled with respect to radial in or counter to the direction of rotation of the impeller. These and other impeller blade configurations are possible and all are contemplated to be within the scope of the present invention. Further, while the configuration of the edge of the center panel, the trough floor, and the upstanding wind baffle shown in FIGS. 1-4 are effective, it is believed that the curved shape illustrated in FIG. 5, again conforming to the curve of an Archimedes spiral, forms a yet more efficient and effective cross-flow fan by defining a rearguider of the fan that conforms more closely to efficient cross-flow fan design. Again, many configurations are possible and all are contemplated to be within the scope of the present invention.

Figure 7:
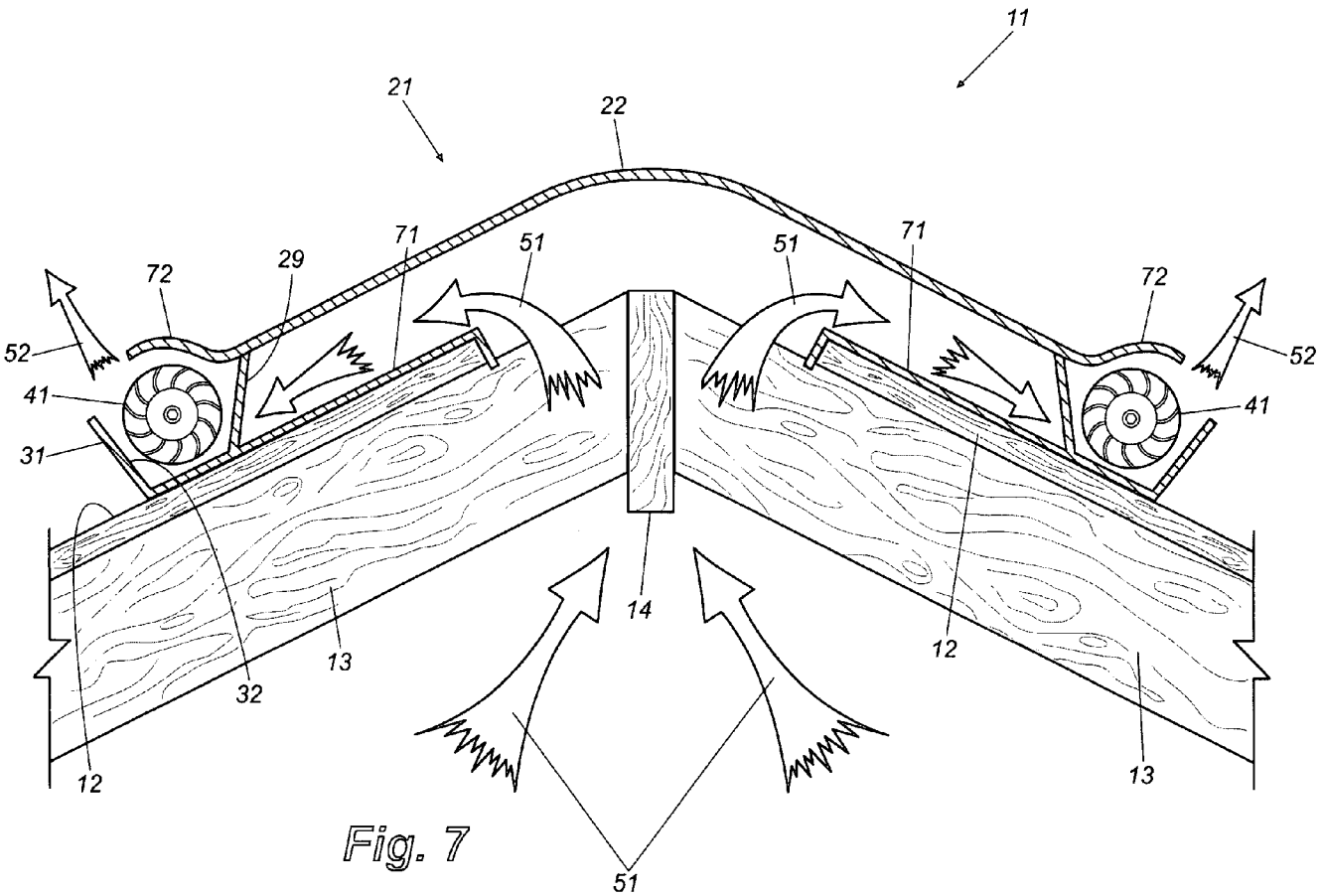
FIG. 7 is a cross sectional view of an embodiment of the present invention similar to the embodiment of FIG. 2 with the addition of an internal bottom panel and a lip or cowl partially overlying the impeller.

FIG. 7 illustrates an alternate embodiment of the present invention that represents a best mode known to the inventors of carrying out the invention. This embodiment is similar in many respects to the embodiment of FIG. 2, and thus components detailed above with regard to FIG. 2 need not be detailed again here. In FIG. 7, the impeller exhaust ridge vent 11 includes, in addition to the elements shown in FIG. 2, base panels 71 that extend inwardly from the region of the impeller to the edges of ridge slot 16. The base panels 71 preferably terminate in downturned lips that wrap over and cover the edges of the ridge slot 16 as illustrated. The base panels 71 overlie and cover the roof deck 12 beneath the ridge vent and are spaced from the center panel 21 to form an air duct or plenum between the center panel 21 and the base panels 71. The base panels 71 provide several beneficial attributes to the ridge vent of this invention, including, for example, creating a air duct with smooth top and bottom walls to minimize turbulence and thereby enhance the efficiency of air flow through the duct; providing a substantially sealed air duct to minimize leakage; enhancing the mechanical integrity of the ridge vent; and better conveying air flow without relying on the structure or condition of the roof deck itself.

The embodiment of FIG. 7 also includes arcuate lips 72 that extend from the edge portions of the central panel 21 partially over the impellers to form cowls that cover a portion of the impellers. It has been found that these lips or cowls enhance the efficiency and performance of the cross-flow fan formed by the impellers and the surrounding structures of the ridge vent. The cowls also serve as a drip edge that helps direct rain water closer to the extreme outer edge of the ridge vent to reduce the water's interference with the impeller and minimize the chance that the water will be blown up and into the ridge slot.

A prototype of the impeller exhaust ridge vent shown in FIG. 1 was constructed by the inventors and tested in a wind tunnel to confirm that a breeze blowing across a roof ridge indeed results in rotation of the tangential impellers within the troughs. The prototype was installed on along the roof ridge of a mocked-up attic section with a 4/12 pitch ratio. Tangential impellers were mounted on opposite sides of the prototype in a manner similar to that shown in FIG. 1. A variable speed axial fan fitted with a nozzle was arranged to create airflow and simulate wind blowing in a lateral direction across the roof and across the prototype ridge vent. Wind speed was measured with an anemometer and rotation of the tangential impellers in rpm was measured with a digital tachometer. The following table outlines the results of the tests.

TABLE 1

Impeller Rotation Test Results

| | Axial Fan With Nozzle | | | Wind Speed | Air Velocity Vent | Air Velocity Vent | Air Velocity Vent | Impeller Speed | Impeller Speed | |
|---|---|---|---|---|---|---|---|---|---|---|
| Test | Frequency Hz | Fan Speed rpm | Sp in WC | Nozzle End mph | Leading Edge fpm | Ridge Line fpm | Trailing Edge fpm | Leading Edge rpm | Trailing Edge rpm | Drain Slots |
| | 0 | 0 | 0.0 | 0.00 | 0 | 0 | 0.00 | 0.00 | 0.00 | open |
| 1 | 5 | 150 | 0.1 | 8.45 | 694 | 167 | 94 | 0 | 0 | open |
| 1A | 5 | 150 | 0.1 | 8.45 | 711 | 187 | 121 | 0 | 0 | open |
| 2 | 10 | 300 | 0.3 | 20 | 1700 | 436 | 345 | 0 | 15 | open |
| 2A | 10 | 300 | 0.3 | 20 | 1591 | 234 | 235 | 0 | 0 | closed |
| 3 | 15 | 450 | 0.6 | 31.57 | 2317 | 688 | 526 | 18 | 56 | open |
| 3A | 15 | 450 | 0.6 | 31.57 | 2205 | 587 | 436 | 0 | 32 | closed |
| 3B | 15 | 450 | 0.6 | 31.57 | 2588 | 736 | 657 | 35 | 69 | open |
| 4 | 18 | 540 | 0.8 | 38.51 | 3115 | 854 | 505 | 184 | 86 | open |
| 4A | 18 | 540 | 0.8 | 38.51 | 3221 | 786 | 625 | 236 | 138 | open |
| 5 | 20 | 600 | 1.0 | 43.13 | 3238 | 987 | 712 | 421 | 332 | open |
| 5A | 20 | 600 | 1.0 | 43.13 | 3496 | 1078 | 859 | 511 | 386 | open |

As can be seen from Table 1, a lateral breeze blowing across the roof ridge and across the prototype ridge vent of the present invention indeed results in significant rotation of the tangential impellers mounted in and extending along the troughs of the ridge vent. For example, impeller rotation of 15 rpm began to occur in this test when the air velocity measured at the vent ridge line was about 436 feet per minute (about 5 miles per hour). As expected, higher wind velocities resulted in higher rotation rates of the impellers with a wind speed at the vent ridge line of 1078 feet per minute (about 12.2 miles per hour) resulting in impeller rotations of 511 rpm on the leading edge of the prototype ridge vent and 386 rpm on the trailing edge. Accordingly, an embodiment of the present invention with free rotating impellers experiences substantial impeller rotation in moderate breezes across a roof.

The invention has been described herein in terms of preferred embodiments and methodologies that are illustrative of the invention and that are considered by the inventors to represent the best mode of carrying out the invention. However, the illustrative embodiments are presented only as examples of the present invention and are not intended to be limiting an any respect. In this regard, many additions, deletions, and modifications might be made to the illustrated embodiments by skilled artisans within the bounds of the invention. For example, while tangential impellers have been illustrated and discussed herein, other types of fans and fan technology might be used to enhance airflow, as may various fan blade configurations. The configurations of the trough and surrounding structures also may be modified or certain structures may be eliminated without destroying the impact and effect of the impeller exhaust ridge vent of this invention. These and other modifications might well be envisioned and implemented by those of skill in the art without departing from the spirit and scope of the invention as set forth in the claims.

What is claimed is:

1. A ridge vent comprising:

an elongated panel having a central portion and edge portions, wherein said central portion has a width sufficient to cover a ridge slot extending at least partially along the ridge of a roof; the panel defining a plane between the central portion and at least one of said edge portion a vent formed along at least one of said edge portions of said elongated panel;

vent louvers extending downwardly from said at least one of said edge portions covering said vent;

a wind baffle outboard of and spaced from said vent;

a trough defined between said vent and said wind baffle, said trough being bounded on the inside by said vent and bounded on the outside by said wind baffle; and a rotatable impeller mounted above the roof in said trough between said vent and said wind baffle, at least a portion of said rotatable impeller projecting above the plane of the central panel and being exposed to ambience for drawing air through said vent and expelling the air to ambience upon rotation of said rotatable impeller.

2. A ridge vent as claimed in claim 1 and wherein said impeller is a tangential impeller.

3. A ridge vent as claimed in claim 2 and wherein said tangential impeller has a plurality of spaced impeller blades, the plurality of impeller blades being radially arrayed about an axis of said impeller.

4. A ridge vent as claimed in claim 3 and wherein each of said impeller blades is curved.

5. A ridge vent as claimed in claim 4 and wherein each of said impeller blades generally follows the curve of an Archimedes spiral.

6. A ridge vent as claimed in claim 3 and wherein each of said plurality of spaced impeller blades extends in a radial direction from said axis.

7. A ridge vent as claimed in claim 1 and wherein said impeller is mounted for free rotation about said axis.

8. A ridge vent as claimed in claim 1 and further comprising a motor coupled to said impeller for rotating said impeller upon activation of said motor.

9. A ridge vent as claimed in claim 8 and wherein said motor is an electric motor.

10. A ridge vent as claimed in claim 9 and wherein said electric motor is powered at least partially by electrical power from electrical service.

11. A ridge vent as claimed in claim 9 and wherein said electric motor is powered at least partially by solar generated electrical power.

12. A ridge vent as claimed in claim 9 and wherein said electric motor is powered at least partially by batteries.

13. A ridge vent as claimed in claim 9 and further comprising a controller coupled to said electric motor, said controller being programmed to activate said electric motor upon the occurrence of predetermined conditions.

14. A ridge vent as claimed in claim 13 and wherein said predetermined conditions include an attic temperature above a preselected threshold.

15. A ridge vent as claimed in claim 13 and wherein said predetermined conditions include an attic humidity above a predetermined threshold.

16. A ridge vent as claimed in claim 13 and wherein said predetermined conditions include a wind speed below a predetermined threshold.

17. A ridge vent for extending along and covering a ridge slot formed along a ridge of a roof having a roof deck, said ridge vent comprising:

a laterally flexible central panel having;

standoffs depending from said central panel toward said deck of said roof to support said central panel a predetermined distance above a said deck of said roof and to define substantially open vents between said edge portions of said central panel and said deck of said roof, for allowing attic air to flow through said ridge slot, through the space between said central panel and said roof deck, and out from beneath the edge portions of said central panel through said vents; the panel defining a plane between the central portion and at least one of said edge portion a wind baffle spaced from each of said edge portions of said central panel, the wind baffles projecting upwardly from said deck of said roof;

a trough defined between said vents and said wind baffles; and a rotatable impeller disposed above the roof at least partially within at least one of said troughs and extending along said vent, said impeller being located above said roof deck and projecting at least partially above the plane of the central panel to draw air from beneath said central panel and expel the air to ambience upon rotation of said impeller.

18. A ridge vent as claimed in claim 17 and wherein said rotatable impeller is mounted for free rotation as a result of wind blowing across said ridge vent.

19. A ridge vent as claimed in claim 17 and further comprising an electric motor coupled to said rotatable impeller, said electric motor being selectively powered by a source selected from an electric service provider, solar cells, batteries, a wind generator, or a combination thereof.

* * * * *